United States Patent [19]

Boggild

[11] 4,084,814

[45] Apr. 18, 1978

[54] GYMNASTIC POLE AND MOUNT THEREFOR

[76] Inventor: Robert Boggild, Graham Home Place Rd., S. Pittsburg, Tenn. 37380

[21] Appl. No.: 731,579

[22] Filed: Oct. 12, 1976

[51] Int. Cl.[2] ..... A63B 9/00

[52] U.S. Cl. ..... 272/110; 248/511; 248/512; 248/524

[58] Field of Search ..... 272/110, 112, 144, 109, 272/70.2; 248/350, 509, 511, 512, 524; 273/DIG. 7, 80.4, 80.2, 80, 193, 26 A, 26 R, 29 A; 138/120, 155, DIG. 2

[56] References Cited

U.S. PATENT DOCUMENTS

| | | | |
|---|---|---|---|
| 2,808,676 | 10/1957 | Major | 43/23 |
| 2,862,710 | 12/1958 | Lewis | 272/144 X |
| 3,119,586 | 1/1964 | Hoffman | 248/524 |
| 3,480,274 | 11/1969 | Boggild et al. | 272/110 |
| 3,834,695 | 9/1974 | Boggild et al. | 272/110 |
| 3,923,302 | 12/1975 | Boggild | 272/110 |

*Primary Examiner*—William R. Browne
*Attorney, Agent, or Firm*—Wood, Herron & Evans

[57] ABSTRACT

A gymnastic amusement device consisting of a pole mounted on a base. The base is adapted to receive a large pole or a small pole or a combination of the two poles, the smaller pole being insertable in the larger pole. The base has a resilient mount supporting a tubular socket. The resilient mount has a vertically adjustable gimbal ring which receives the socket. The combination of the resilient mount, its adjustability, and the utilization of the poles separately or in combination provides a device suitable for a wide range of weights of persons using the device.

15 Claims, 8 Drawing Figures

GYMNASTIC POLE AND MOUNT THEREFOR

This invention relates to a gymnastic amusement device, and more particularly, the invention is directed to a fiber glass pole which is secured at its lower end to a mount, the mount in turn being secured to the ground or a floor. The pole to which the invention is directed has been disclosed in U.S. Pat. Nos. 3,246,893; 3,480,274; 3,834,695; and 3,923,302.

The poles and mounting means for the poles in those patents have been satisfactory insofar as providng an exciting gymnastic exercise for the person using the pole. However, the poles have been somewhat limited insofar as the range of weights of the persons using the pole is concerned. For example, a small or thin pole is satisfactory for a person whose weight is in the range of about 60 – 100 pounds, but is too resilient for a person in the 150 – 200 pounds range. On the other hand, a large pole satisfactory for a large person is too stiff for a small person.

An objective of the present invention has been to provide a pole and mount combination suitable for use with the entire range of persons from small to large, that is, from between 60 – 200 pounds.

The foregoing objective is achieved by providing a small pole for the smaller person, a large pole for the medium size person, the smaller pole being insertable into the large pole to provide a combined pole of sufficient stiffness to accommodate the largest person in the range. The invention further contemplates the provision of a mount which supports the lower end of the pole resiliently and permits it to swing, to a limited extent, around a circle to absorb up to about 50% of the strain on the pole. The invention still further contemplates the adjustability of the resilient mount so as to vary within a limited range the amount of strain absorbed by the mount. Thus, with any of the three pole combinations (small pole, large pole, two pole) the stiffness of the pole action can be varied and a larger person within a range can have as exciting a ride as the smaller person within the range.

The resilient mount also tends to promote a longer life for the pole. A stiffer pole will have a longer life than a more flexible pole since the stiffer pole is not bent to such a great extent as the more flexible pole. By absorbing a substantial portion of the flexure of the device within the mount, the pole is flexed to a lesser extent and hence the strain upon the pole is substantially reduced, all of which promotes the longer life of the pole.

Another objective of the invention has been to provide the combination of a mount and means for receiving any of the small pole, the large pole, or the combination of two poles.

Another objective of the invention has been to provide a mount adapted to secure the bottom of the pole at two locations, the spacing of the two locations being variable to vary the amount of flexure absorbed within the mount when the pole is in use.

Another objective of the invention has been to provide means for attaching a resilient cord within the mount in a serpentine fashion so as to provide the desired resilience within the mount. The securing of the resilient cord within the mount is done in such a way as to prevent its slipping within its attachment points and thus destroying the uniformity around the 360° of its resilient action. The cord is nevertheless easily removed and replaced.

These and other objectives of the invention will become more readily apparent from the following detailed description taken in conjunction with the accompanying drawings in which.

GENERAL ORGANIZATION AND OPERATION

Figure 1:
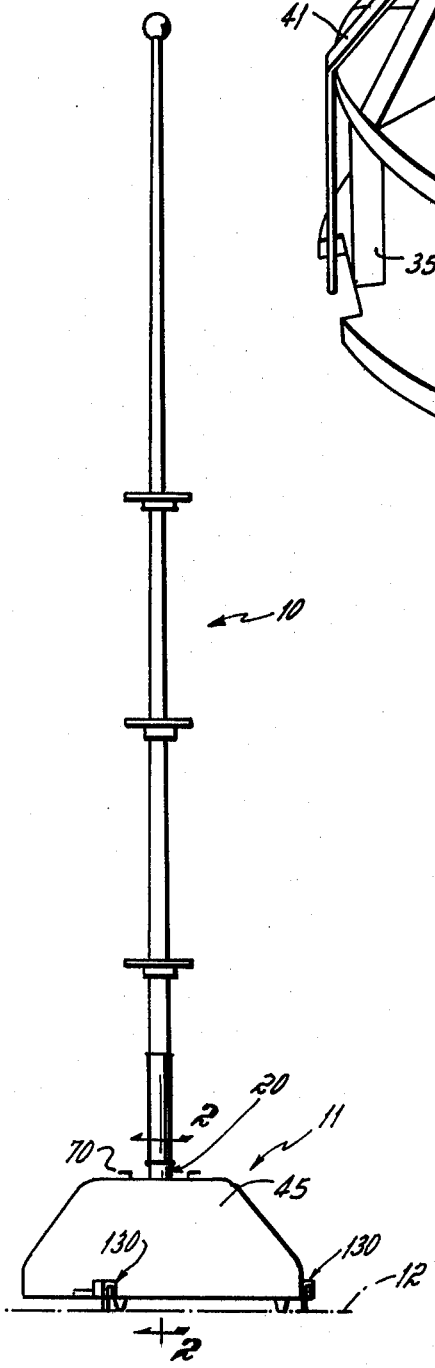
FIG. 1 is a diagrammatic view illustrating fiber glass pole and associated mounting.

As shown in FIG. 1, the invention consists of a flexible fiber glass pole 10 supported in a mount 11, the mount 11 being secured either to the ground or to the floor of a gymnasium or the like indicated at 12.

As will be seen in more detail below, the pole may be a small or thin pole capable of supporting a person whose weight is approximately in the range of 60 – 100 pounds; a large pole capable of supporting a person whose weight is approximately in the range of 100 – 140 pounds; and a third pole consisting of the combination of the two poles, the smaller pole being inserted in the larger pole, the combination being capable of supporting a person whose weight is approximately in the range 140 – 200 pounds. Both large and small poles are about 12 feet long.

The invention contemplates the use of a plurality of steps which are removably mounted to either the large pole or the smaller pole, preferably using mounting means of the type disclosed in my U.S. Pat. No. 3,834,695.

Figure 2:
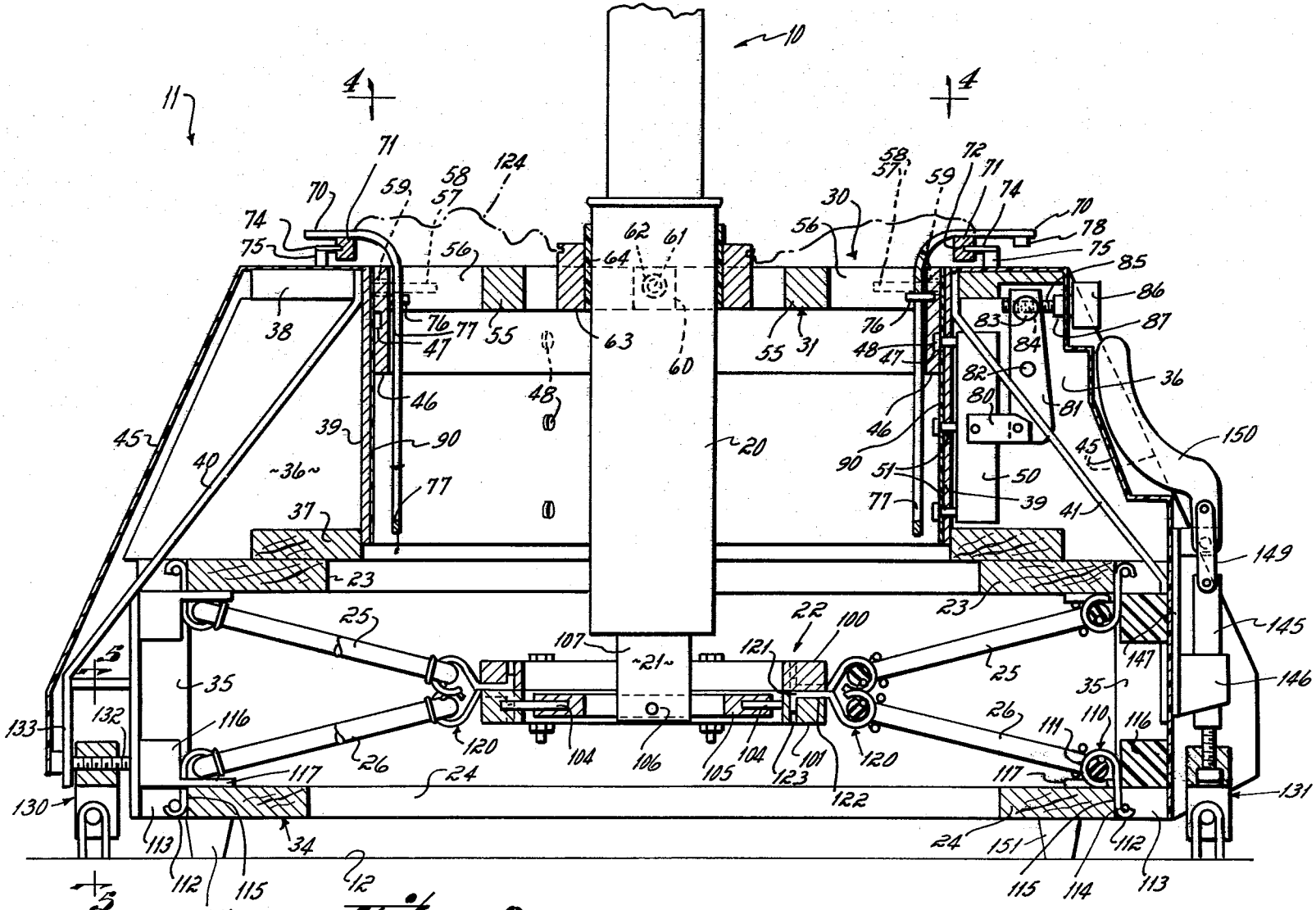
FIG. 2 is a cross-sectional view taken on line 2—2 of FIG. 1.

As best shown in FIG. 2, the lower end of the pole 10 is adapted to be removably mounted in a mount socket 20 which is permanently mounted in the pole mount 11. The mount socket 20 is secured at its lower end 21 to a gimbal support 22. The gimbal support 22 is resiliently connected to a pair of spaced upper and lower rings 23 and 24 by a pair of elastic cords 25, 26 in a manner to be described below. The upper portion of the mount socket 20 is supported by an adjustable ring 30 which is rotatable in order to vary its axial position with respect to the mounting socket. In the preferred embodiment of the invention, the mount socket is about 1 foot long and the supporting ring 30 is adapted to be infinitely adjustable within the upper approximately 5 inches of the mounting socket.

The adjustable ring 30 includes a gimbal ring support 31 for the upper portion of the mount socket 20. By rotating the adjustable ring 30, the location of the engagement of the ring with respect to the mounting socket may be axially varied.

The operation of the invention as thus far described may be considered in relation to the use of the device by persons of differing sizes. The largest person, in the 140 – 200 pounds range, inserts the smaller pole within the larger pole and inserts that assembly into the mount socket. The adjustable ring 30 would be placed at its uppermost position for the largest person in the large size range so as to prevent his overstressing the pole. A smaller person in the large size range may wish to lower the adjustable ring 30, preferably within the upper third of its adjustment range, in order to provide a more resilient or less stiff ride on the pole.

The person in the middle range would use only the large size pole, having removed the smaller size pole. Again, with the larger person in the middle range, the adjustable ring 30 would be positioned at the upper position in the middle third of the adjustment range, that is, 2 – 4 inches above the lowermost position in the preferred embodiment.

The smaller person would use only the smaller pole and would adjust the adjustment ring, as desired, in the lower third of the adjustment range.

Through the use of the two poles, providing three stiffness ranges, and the cooperating adjustable ring, it is possible for the participant to get the most exciting ride, utilizing both the resilience of the pole and the resilience of the cord support for the mount socket 20 consistent with the preservation of the long life of the pole.

The Pole Mount

Figure 3:
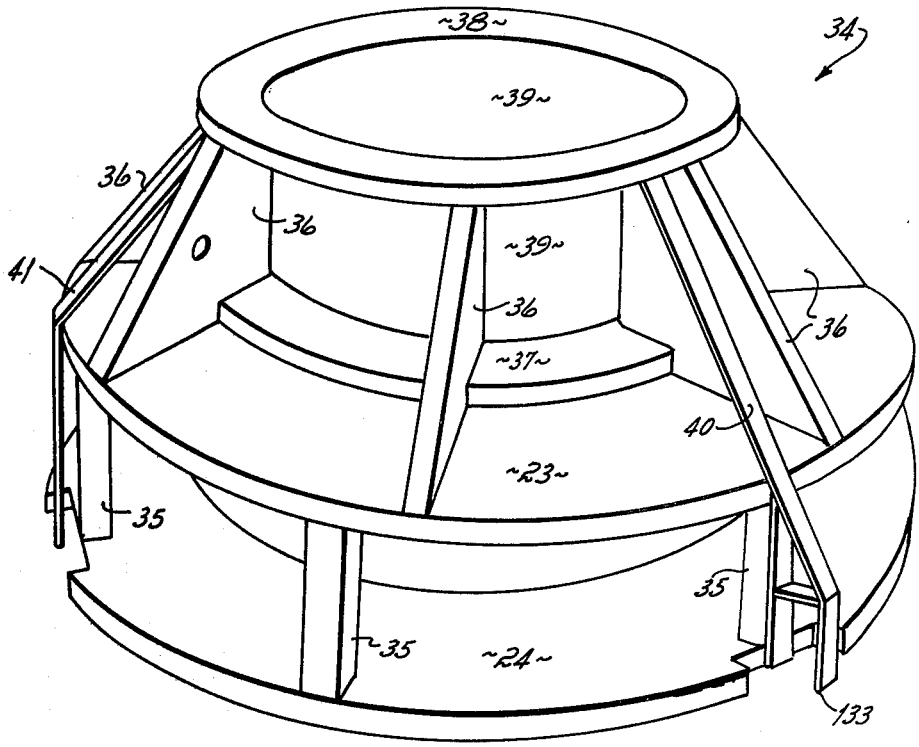
FIG. 3 is a diagrammatic perspective of the frame construction.

The basic frame 34 for the pole mount, as best shown in FIGS. 2 and 3, consists of the two rings 23, 24 which are interconnected by vertical posts or struts 35 uniformly spaced around the perimeter of the rings. The upper ring 23 supports triangular struts 36 also uniformly spaced around the periphery of the ring. The upper portion of the frame 34 includes a ring 37 which is fixed to the ring 23 and the struts 36. Spaced above the ring 37 is a ring 38 which is secured to the upper edges of the struts 36. A metallic sleeve 39 forming part of the frame is fixedly mounted between the rings 37 and 38. Two straps 40 and one strap 41 equiangularly spaced around the frame are secured to the vertical posts 35 at their lower ends and to the upper end of the metallic sleeve 39. The complete frame 34 is encased by an outer fiber glass shell 45 which imparts rigidity to the assembly.

The adjustable ring assembly 30 is supported by the metallic sleeve 39. A ring 46 has helical grooves 47 formed in its outer surface to provide a triple thread screw having a 6 inch pitch. The grooves receive three vertically spaced studs 48. Three sets of the studs are positioned equiangularly around the sleeve 39. Two sets are fixed to the sleeve 39, the remaining set being fixed to a braking block 50 which is radially movable with respect to the sleeve 39 in order to lock the adjustable ring assembly 30 into a selected position, as will be described below. Holes 51 are provided in the sleeve to permit the studs 48 to move radially with respect to the sleeve when the block 50 is moved.

Figure 4:
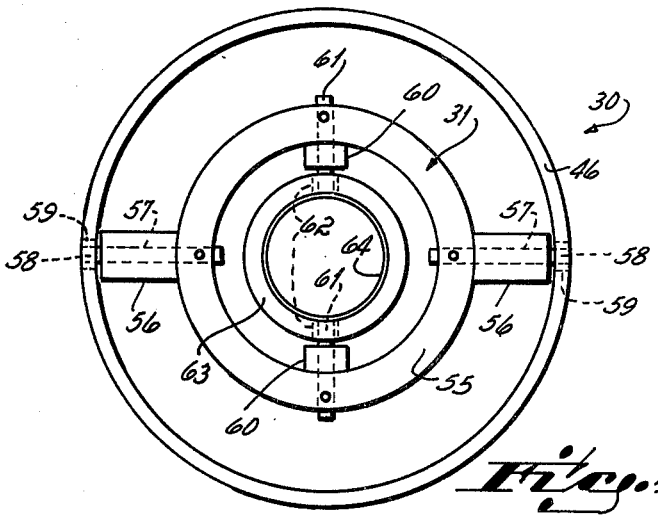
FIG. 4 is a view taken on line 4—4 of FIG. 2.
Figure 5:
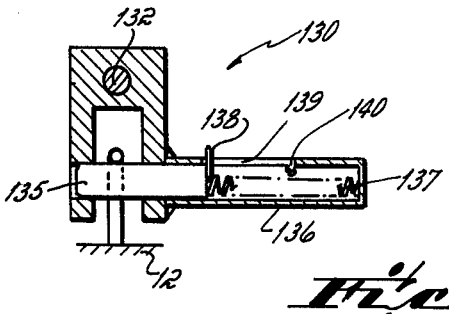
FIG. 5 is a view taken on line 5—5 of FIG. 2.

As best seen in FIG. 4, the upper gimbal ring includes an outer ring 55 having two diametrically opposed bosses 56 projecting radially outwardly. Each boss has a hole 57 adapted to fixedly receive a steel mounting pin 58, the mounting pin 58 being journalled in a bushing 59 secured to the threaded ring 46.

The outer ring 55 carries a pair of diametrically opposed, fixed bosses 60 which project inwardly. A pin 61 is fixed in each boss and is pivotally mounted in self-lubricating plastic bushings 62 in an inner ring 63. The inner ring 63 carries a self-lubricating plastic bushing 64 which is in a close fitting, sliding engagement with the mount socket 20.

Referring to FIG. 2, a pair of diametrically opposed positioning handles 70 are fixed to a ring 71. The ring 71 has an annular slot 72 which receives three equiangularly positioned hold-down brackets 74 which are in turn fixed to the plastic shell 45 by a block 75. Each handle is connected to the threaded ring by a pin 76 riding in a vertical slot 77 in each handle. One of the handles has a stop 78 which is engageable by one of two pins projecting upwardly from the outer shell 45 to limit the rotation of the handles to approximately 300°. A 300° rotation of the handles 70 will drive the threaded ring 46, through the pin and slot connection 76, 77, axially a distance of approximately 5 inches. Preferably, indicia are provided on the shell as, for example, the numbers 1 – 10 so that once a person arrives upon a desired setting, he can return to that setting the next time he uses the pole.

When the threaded ring 46 is in the desired axial position, it is desirable to lock it in that position. To that end, the braking block 50 is adapted to move inwardly, thereby causing one of the studs 48, then in engagement with the ring, to force the ring to shift slightly eccentrically to the other side of the shell, thereby clamping it against the other side of the shell and preventing further rotation and axial movement.

The brake block 50 is connected by a link 80 to a pivot arm 81 which is pivoted at 82 to two of the vertical struts 36 (two vertical struts being located in close proximity to each other to sandwich the pivot bar between them).

The upper end of the pivot bar carries a round bar 83 having a threaded bore 84 which receives a screw 85 fixed to a knob 86. The knob is rotatably mounted on a bearing plate 87 secured to the shell 45. As can be seen, rotation of the knob 86 causes a swinging of the pivot bar and a corresponding movement of the brake block toward or away from the threaded ring 46 to lock or release the ring, respectively.

Preferably, a self-lubricating plastic liner 90 is mounted on the sleeve 39 and interposed between the sleeve and the threaded ring 46 to keep the two, which are preferably aluminum, from galling during operation of the invention.

The lower gimbal support 22 includes a pair of outer rings 100, 101 which are bolted together, as will be described. The lower ring 101 has two diametrically opposed, fixed pins 104 which project radially inwardly and are mounted to a pivot block 105, thereby pivotally supporting the block 105 on the ring 101. The block 105 has a transverse pin 106 passing through it and pivotally mounted to a stud 107 depending from the lower end 21 of the mount socket 20. The lower elastic cord 26 is passed in serpentine fashion between the plywood ring 24 and the lower gimbal ring 101.

In the plywood ring 24, an S-shaped hook 110 is loosely wrapped at one end 111 around the cord. The other end 112 is hook shaped to pass into a slot 113 and under a retaining ring 114 which is wrapped around the circumference of the plywood ring 24. The S-shaped hook 110, mounted on the cord, is fixed in position by tilting it radially outwardly and dropping the hook 112 under the retaining ring 114 and then swinging back to a more vertical orientation, as shown. There it is blocked against further radially inward swinging by the radially inner end 115 of the slot 113. Thereafter, a flexible keeper 116 having horizontal, inwardly-projecting legs 117 straddling the hook is slipped into position between the shell 45 and the hook.

At its radially inner end the cord 26 is mounted on similar S-shaped hooks 120 having hooked ends 121 which lie partially in a slot 122 formed in the upper surface of the ring 101 with the end of the hook dropping into a bore 123 passing through the ring. The hook 120 is clamped in that position when the upper ring 100 is bolted to it.

The free ends of the cord are looped through individual S-shaped hooks and secured to the plywood ring 24 in the manner described in connection with the hooks 110.

At both inner and outer hook locations, a butterfly clip surrounds the cord on either side of the hook thereby crimping the cord to the hook. The butterfly clip is crimped to the cord on each side of the hook and provides a bearing surface interposed between the cord and the hook to reduce wear of the cord during operation. Further, the butterfly clip prevents the cord from slipping around the hooks and developing an imbalance of forces as the mount socket rotates through 360°.

The upper cord is connected to the upper plywood ring 23 and the upper gimbal ring 100 in a manner identical to that described in connection with the lower cord. The cord connections are spaced angularly from each other so that the upper cords are connected in between the connection points of the lower cord. The bolting of ring 100 to ring 101 secures both upper and lower cord connections to the two rings.

A boot 124 is connected to the inner gimbal ring 63 and to the ring 71 and has enough flexibility and slack to permit the inner gimbal ring to move up and down the mount socket while enclosing the upper end of the mount and keeping it free from dirt.

The mount described above is removably fixed to three eyebolts or chain links anchored to the floor or anchored in concrete in the ground. The three eybolts are spaced equiangularly around the mount and are captured in two fixed clevises 130 and a movable toggle-actuated clevis 131. The fixed clevises are secured to an anchor strap assembly 40 by a bolt 132 passing through the bifurcated end 133 of the two anchor straps 40. The clevis is slidable on the bolt 132 and also swingable so as to provide a flexibility of engagement with the eyebolt to which it is to be connected.

All three clevises have a sliding bolt 135 carried in a housing 136. A compression spring 137 is mounted within the housing and urges the bolt 135 into a position across the two legs of the clevis passing through the hole in the eyebolt. A pin is fixed to the end of the bolt 135 and passes through a longitudinal slot 139 in the housing. A pair of notches 140 enable the bolt to be locked in the retracted and operative positions.

The third or toggle clevis 131 is fixed to a rod 145 slidable in a bracket 146 which is connected through a plate 147 and shell 45 to a post 35. The rod is connected to a link 149 and the link is connected to an operating arm 150 pivoted to the plate 147 to raise and lower the clevis and provide a toggle lock therefor.

Opposite each clevis is a resilient pad 151 secured to the ring 24. In securing the mount to the eyebolts, the mount is first cocked upwardly, raising the toggle clevis 131. The opposite two clevises 130 are secured to their respective eyebolts by passing the bolt 135 through the eyebolts. The toggle clevis is lowered by swinging the arm 150 downwardly to permit it to be captured in its eyebolt. The toggle clamp is then swung upwardly. As it swings upwardly, drawing the toggle clevis 131 upwardly, all pads 151 are compressed and the mount is securely fastened to the eyebolts or chain links.

The Pole Construction

Figures 6, 7, 8:
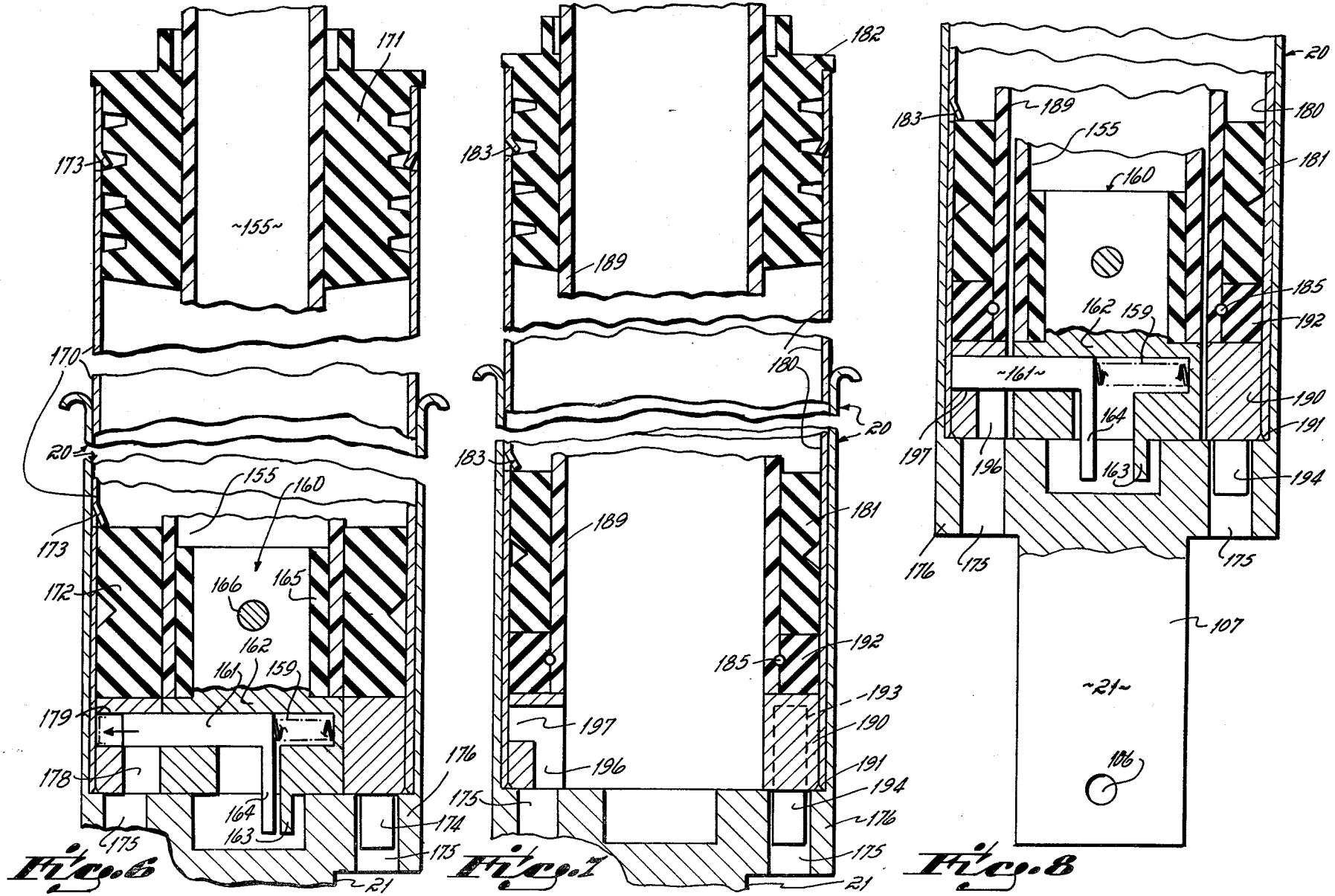
FIG. 6 is an enlarged cross-sectional view of the small pole mounting.
FIG. 7 is an enlarged cross-sectional view of the large pole mounting.
FIG. 8 is an enlarged cross-sectional view of the combined poles mounting.

Referring now to FIGS. 6–8, the large pole 189 is hollow and is inwardly tapered, being large at the bottom and small at the top. The small pole has a similar outer taper enabling it to mate with the inner taper of a large pole. When in position, the inner pole loosely engages the inner surface of the larger pole with about 0.040 clearance.

The small pole 155 is hollow and at its lower end receives a plug or fitting 160 to which is secured a slidable locking bolt 161 mounted in a housing 162. A compression spring 159 is located between the bolt 161 and the housing 162 to urge the bolt outwardly. A pair of pins 163 are fixed to the housing. A pin 164 is fixed to the bolt 161 so that when the pins 163 and 164 are squeezed together, the bolt is withdrawn to enable it to be inserted and removed from the fittings of the mounting tubes for either the large pole, or the small pole, as will be described. The plug has a rubber sleeve 165 surrounding it and is secured to the pole by a retaining pin 166.

The small pole has a short mounting tube 170 to which upper and lower resilient bushings 171 and 172 are secured. The bushings are of the type disclosed in my U.S. Pat. No. 3,834,695. The bushings 171, 172 are secured in position by retainer lugs 173 struck from the tube 170 and pressed inwardly to engage the bushings. The tube 170 has an axially extending pin 174 which is engageable in any one of eight holes 175 formed in a ring 176 forming a part of the lower end 21 of the mount socket 20. The plurality of holes in the bottom of the mount socket provides for a random positioning of the pole in different angular positions with respect to the mount socket each time it is removed and replaced, thereby making the wear on the pole more uniform.

The tube 170 has an axial groove 178 which is adapted to receive the bolt 161 when the small pole is mounted in the tube 170. Thus, the pole is prevented from rotating with respect to the tube and, as indicated above, the tube is prevented from rotating with respect to the mount socket by the pin 174 dropping into one of the holes 175. This assures that the participant will not feel the pole slipping rotationally as he is attempting to impart body english as he swings about the pole. To use the small pole, it is simply slid into its mounting tube with the pin riding in the groove 178 and dropping into bore 179 and then the mounting tube is dropped into the mount socket.

The larger pole 14 is permanently secured to its mounting tube 180. It has upper and lower bushings 181 and 182 formed in the manner described in U.S. Pat. No. 3,834,695 fixed to its lower end. The pole is slid into the mounting tube and retainer lugs 183 struck from the surface of the mounting tube are pressed inwardly into retaining engagement with the resilient bushings 181 and 182. A retaining ring 185 is fixed to the pole below the lower resilient bushing 181.

The lower end of the mounting tube 180 is closed by a collar 190 which is inserted in the mounting tube in butting engagement with the lower end of the large pole 189 and welded into place as at 191. The space between the collar 190 and the lower resilient bushing 181 is sealed by pouring into that area, through a hole drilled for that purpose, a urethane plastic 192 which sets up and thus casts in situ. The plastic in engagement with the wall of the large pole and the ring secured to it prevents the large pole from rotating with respect to the tube mount 180. The collar 190 has a longitudinal bore 193 into which an axially extending pin 194 is fixed, the pin 194 being for the same purpose as the pin 174, that is, to be received in one of the holes 175 and in the member 176 forming the bottom of the mount socket. With the pin in place, the pole is prevented from rotating with respect to the mount when it is in use.

The collar also has a longitudinal groove 196 terminating in a transverse bore 197 which is adapted to receive the bolt 161 fixed on the plug 160 of the bottom of the small pole. Thus, when the small pole is inserted in the large pole, it may be fixed within the large pole by manipulating the bolt 161 so as to drop it into the bore 197 in a manner similar to the manner in which the small tube is inserted into its mounting tube 170.

Operation

In the operation of the invention, a small person inserts the small pole 155 into the mounting tube 170 by first retracting the bolt 161 until it slides in the groove 178 into position in the mount 170. Thereafter, the mount tube is dropped into the mount socket 20 with the pin 174 being positioned in one of the holes 175 in the ring 176. The handles 70 associated with the threaded ring 46 are rotated to position the upper gimbal at the desired level. For example, for a very small child the gimbal ring would be completely lowered to a location about midway between the upper and lower ends of the mount socket. If the weight of the person is great enough that the lowering of the gimbal ring to that position provides too great a flexibility in the pole action, the action may be stiffened by raising the gimbal ring. When the person achieves the desired combined flexibility of pole and mount, he can note the setting by observing the position of the handles with respect to the indicia so that when he next takes a turn on the pole he can immediately make the proper setting.

When it is the turn of a larger person, he simply removes the small pole and inserts the large pole 189, positioning the pin 194 within one of the holes 175 of the ring 176. Again, the desired setting of mount resistance can be made by manipulating the handles 70.

When it comes the turn of the largest person, he inserts the small pole, minus its mount 170, into the large pole, drawing back the bolt 161 until it can be released and dropped into the bore 197. The combined poles are then dropped into the mount socket and adjustment made of the mount resistance by manipulating the handles 70.

Having described my invention, I claim:

1. In a gymnastic amusement device, a mount for receiving a fiber glass pole comprising, a frame for supporting a fiber glass pole, a pole socket means having an upwardly projecting free end and disposed centrally within said frame, resilient means positioned at the free end portion of the socket means and adapted for supporting the socket means, means supporting the upper end of said socket means, said supporting means being vertically adjustable with respect to said socket means, said supporting means comprising, pole regidity adjustable ring means encircling the socket means, said ring means having external threads with at least one stud mounted on said frame projecting into said threads so that rotation of said ring means with respect to said studs effects the raising and lowering of said ring means, and means connecting said ring means to said socket means.

2. The mount as in claim 1 in which said connecting means comprises a gimbal ring connected between said adjustable ring means and said socket, respectively, to permit said socket means to angulate with respect to said adjustable ring means around 360°.

3. A mount as in claim 2 in which said resilient means comprises at least one resilient cord connected in serpentine fashion to said frame and presenting inner loops connectable to the lower end of said socket means and a gimbal ring connected between said inner loops and said socket means.

4. A mount as in claim 3 further comprising, a second resilient cord disposed in serpentine fashion between said frame and said gimbal ring, the connections of said cord to said frame being vertically spaced from said at least one resilient cord.

5. A mount as in claim 1 further comprising, a plurality of studs circumferentially spaced around said frame and engageable with said threads on said adjustable ring means.

6. A mount as in claim 5 in which the studs at at least one angular position around said frame are radially movable, and means for radially pressing said studs against said adjustable ring means to clamp said adjustable ring means in a preselected position with respect to said socket.

7. A mount as in claim 1 further comprising, a shell surrounding said frame, said threaded ring means having at least one handle projecting from said ring means outside of said shell, and indicia on said shell indicating the axial position of said adjustable ring means.

8. A mount as in claim 1 further comprising, a flexible boot secured between said frame and said adjustable ring means to prevent dirt and the like from entering the mount.

9. In a gymnastic amusement device, comprising, a frame for supporting a fiber glass pole, a socket disposed centrally within said frame, resilient means positioned at the free end portion of the socket means and adapted for supporting the socket means, means supporting the upper end of said socket means, said supporting means being vertically adjustable with respect to said socket means, said supporting means comprising, a plurality of clevis means mounted on the frame and spaced circumferentially around said base, one of said plurality of clevis means being vertically movable with respect to the frame, said clevises being adapted to engage eyebolts or the like in the floor or ground to clamp the frame to the floor or ground by connecting the plurality of clevis means to the eyebolts and thereafter raising at least one of said plurality of clevis means to lock the frame to eyebolts or the like.

10. A mount as in claim 9 further comprising, resilient pads mounted on said frame and having portions spaced below said plurality of clevis means.

11. A mount as in claim 9 further comprising, spring-loaded bolts mounted in said plurality of clevis means and adapted to receive said eyebolts.

12. A gymnastic amusement device comprising, a frame for supporting the device, a tubular socket mounted in said base with its axis vertically oriented, an elongated, large, hollow fiber glass pole which is about 12 feet long positionable within a mounting tube, a mounting tube means for supporting the large pole, two vertically spaced bushing means within said tube means for securing said large pole to said mounting tube means, said mounting tube means functioning to anchor the large pole inserted in said socket and to prevent displacement of the anchored portion of the large pole during a exercise program on the large pole, a small fiber glass pole about 12 feet long removably insertable in said large pole along the longitudional axis of the large pole in a telescoping manner.

13. A device according to claim 12 further comprising, a second mounting tube removably mountable on the bottom of said small pole, and means including a fitting at the lower end of said small pole for locking said second mounting tube to said tubular socket.

14. A device as in claim 13 in which said locking means comprises, a transverse bolt slidably mounted in said fitting, spring means normally urging said bolt radially outwardly beyond said fitting, and a compression spring between said bolt and said fitting urging said bolt outwardly.

15. A device as in claim 14 in which the projecting portion of said tubular mount has a longitudinal groove at its lower end and a transverse bore communicating with said groove, said bore being adapted to receive said bolt.

* * * * *